US007215103B1

(12) United States Patent
Wong et al.

(10) Patent No.: US 7,215,103 B1
(45) Date of Patent: May 8, 2007

(54) POWER CONSERVATION BY REDUCING QUIESCENT CURRENT IN LOW POWER AND STANDBY MODES

(75) Inventors: Kern W. Wong, Sunnyvale, CA (US); Kenneth Robert Marasco, Scotts Valley, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 226 days.

(21) Appl. No.: 11/022,128

(22) Filed: Dec. 22, 2004

(51) Int. Cl.
*G05F 1/573* (2006.01)

(52) U.S. Cl. ..... 323/277; 323/270; 323/279; 323/303

(58) Field of Classification Search ..... 323/270, 323/273, 275, 276, 277, 279, 303
See application file for complete search history.

(56) References Cited

U.S. PATENT DOCUMENTS 3,480,852 A * 11/1969 Hung ..... 323/279
4,800,331 A * 1/1989 Vesce et al. ..... 323/277
5,274,323 A * 12/1993 Dobkin et al. ..... 323/280
5,334,928 A * 8/1994 Dobkin et al. ..... 323/280
5,552,697 A * 9/1996 Chan ..... 323/282
5,563,501 A * 10/1996 Chan ..... 323/282
6,046,577 A * 4/2000 Rincon-Mora et al. ..... 323/282
6,188,211 B1 2/2001 Rincon-Mora et al.
6,310,467 B1 * 10/2001 Sauer ..... 323/273
6,522,111 B2 * 2/2003 Zadeh et al. ..... 323/277
6,603,292 B1 * 8/2003 Schouten et al. ..... 323/277
6,677,735 B2 1/2004 Xi
6,856,124 B2 2/2005 Dearn et al.
6,867,573 B1 * 3/2005 Carper ..... 323/277

OTHER PUBLICATIONS

Rincon-Mora et al, *A Low-Voltage, Low Quiescent Current, Low Drop-Out Regulator*, 33 IEEE Journal of Solid-State Circuits 1 (Jan. 1998).

* cited by examiner

*Primary Examiner*—Jeffrey Sterrett
(74) *Attorney, Agent, or Firm*—Darby & Darby PC; John W. Branch

(57) ABSTRACT

A method and circuit for automatically lowering a quiescent current at a predetermined threshold. A compact and low power current comparator is employed to detect the power consumption conditions, and issues a control signal to lower current consumption within a power management circuit. By dynamically resizing bias device geometries, a minimum quiescent current of an electronic device may be further reduced. Moreover, the control signal may also be used to engage modification of circuit dynamics to improve circuit performance and mitigate a response profile during recovery from a low power operation.

19 Claims, 4 Drawing Sheets

POWER CONSERVATION BY REDUCING QUIESCENT CURRENT IN LOW POWER AND STANDBY MODES

FIELD OF THE INVENTION

The present invention relates to power management in electronic devices and more specifically to a circuit and method for conserving power by reducing quiescent current in low power and standby modes.

BACKGROUND

Power management is one of the most important areas of electronic design. With the proliferation of portable devices and complex, multi-functional integrated circuits, a variety of regulated supply voltages are generally provided to various circuits within a microchip or in a plurality of microchips.

Present CMOS technologies for Low-Dropout Voltage (LDO) regulators of moderate output current (e.g. up to half ampere) dissipate more than a few mA quiescent current at low loading or no loading conditions. Some specialty LDOs of very low power may provide just a few mA's, which may be adequate to power real-time clock and RAM memory circuits. The minimum quiescent current dissipated by a circuit generally relates to a maximum output power requirement of the circuit. Thus, transistors size and their biasing conditions are determined by the size of a series pass transistor and the LDO's overall power handling specification. If bias devices are sized smaller or biased leaner, lower quiescent current may result, but this could heavily compromise the LDO's output power capability and circuit performance characteristics. In the area of portable devices, typical general purpose LDOs may provide 50 mA to over 500 mA.

Thus, it is with respect to these considerations and others that the present invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Invention, which is to be read in association with the accompanying drawings, wherein.

DETAILED DESCRIPTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment or an embodiment combining software and hardware aspects. The following detailed description is, therefore, not to be taken in a limiting sense.

Briefly stated, the present invention is directed to a method and circuit for automatically lowering a quiescent current at a predetermined threshold. A compact and low power current comparator is employed to detect the power consumption conditions, and issues a control signal to lower current consumption within a power management circuit. By dynamically resizing bias device geometries, a minimum quiescent current of an electronic device may be further reduced. Moreover, the control signal may also be used to engage modification of circuit dynamics to improve circuit performance and mitigate a response profile during recovery from a low power operation.

While a preferred embodiment of the present invention may be implemented in an LDO regulator circuit, the invention is not so limited. The described circuit may be employed as part of virtually any power supply circuit known to those skilled in the art.

Figure 1:
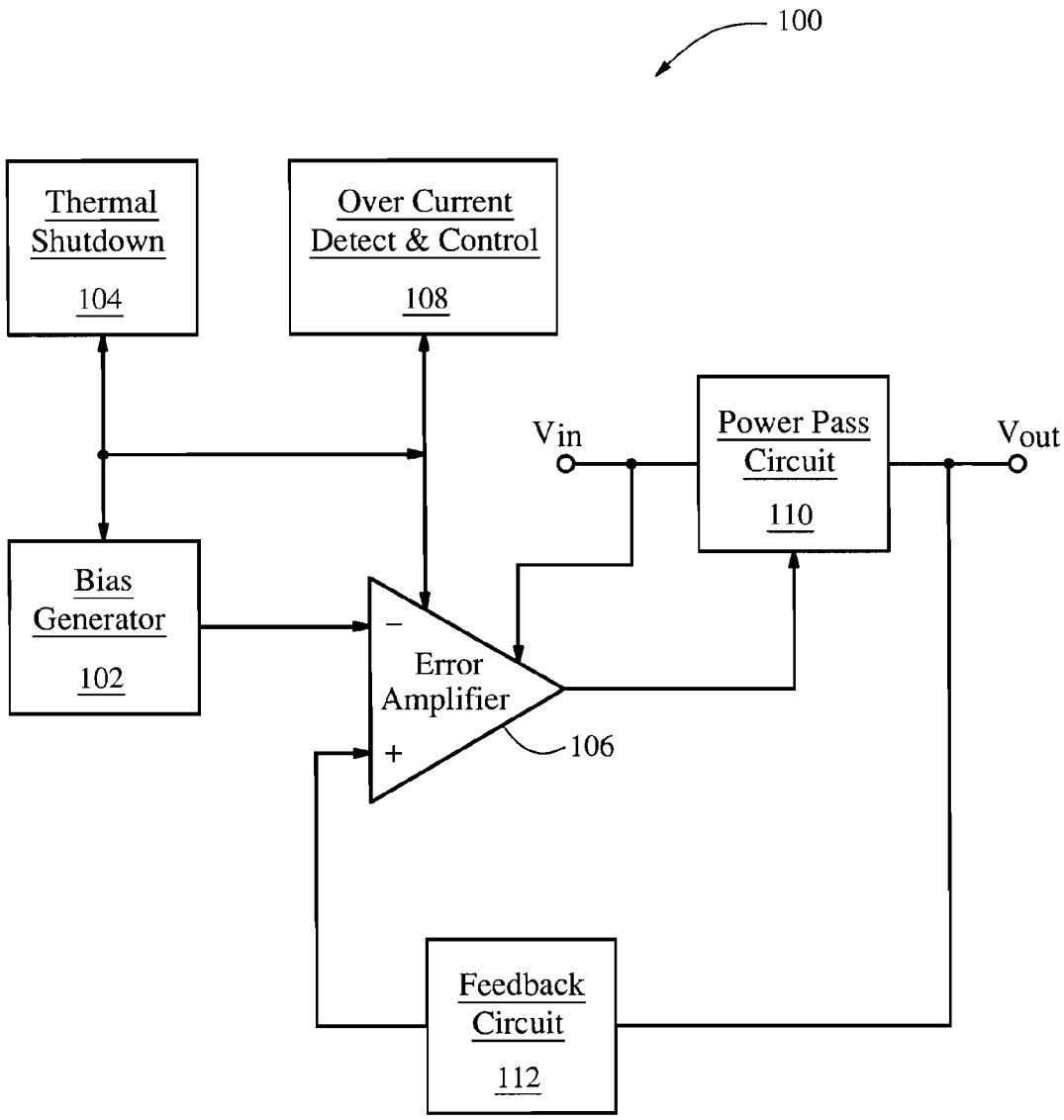
FIG. 1 illustrates a block diagram of an embodiment of an LDO regulator in which the present invention may be practiced.

FIG. 1 illustrates a block diagram of an embodiment of LDO regulator 100 in which the present invention may be practiced. LDO regulator 100 includes thermal shutdown circuit 104, bias generator 102, error amplifier 106, over current detect and control 108, power pass circuit 110, and feedback circuit 112.

LDO regulator 100 is arranged to receive an input voltage $V_{in}$ and provide regulated output voltage $V_{out}$. $V_{in}$ may be provided by a power source including a battery, a power adapter such as an AC/DC converter, a DC/DC power converter, and the like.

Power pass circuit 110 is arranged to receive $V_{in}$ as well as an error voltage from error amplifier 106 and to provide regulated output voltage $V_{out}$ in response to $V_{in}$ and the error voltage. In one embodiment power pass circuit 110 may include a series power pass transistor.

Feedback circuit 112 is arranged to receive $V_{out}$ and to provide a feedback voltage to a non-inverting input of error amplifier 106. Bias generator 102 is arranged to provide a bias voltage to the inverting input of error amplifier 106. An operation of error amplifier 106 is controlled by at least three safety mechanisms. A first safety mechanism is a thermal shutdown signal provided by thermal shutdown circuit 104.

Thermal shutdown circuit 104 is arranged to monitor a temperature of LDO regulator 100 and provide the thermal shutdown signal turning off error amplifier 106 as well as bias generator 102, thereby effectively turning off LDO regulator 100.

A second safety mechanism for error amplifier 106 is provided by over current detect and control circuit 108. Over current control and detect circuit 108 may monitor an output current and turn off error amplifier 106, if a predetermined limit is exceeded.

Finally, a third safety mechanism may be provided by input voltage $V_{in}$. Error amplifier 106 may be arranged to turn off if $V_{out}$, drops below a predetermined limit preventing a drop in $V_{out}$ below a specified range.

FIG. 1 shows a particular arrangement of inputs and outputs of the various components of LDO regulator 100. In one embodiment, all of the components of LDO regulator 100 may be included in the same chip. Alternatively, one or more of the components may be off-chip. LDO regulator 100 may further be an independent power supply circuit, a subcircuit of a Power Management Unit Integrated Circuit (PMUIC), and the like.

In another embodiment, LDO regulator 100 may provide further functions such as providing a regulator output to track to a reference LDO, switching of the reference input between an LDO output and its own internal bandgap voltage, and programmable output via a serial bus interface.

Figure 2:
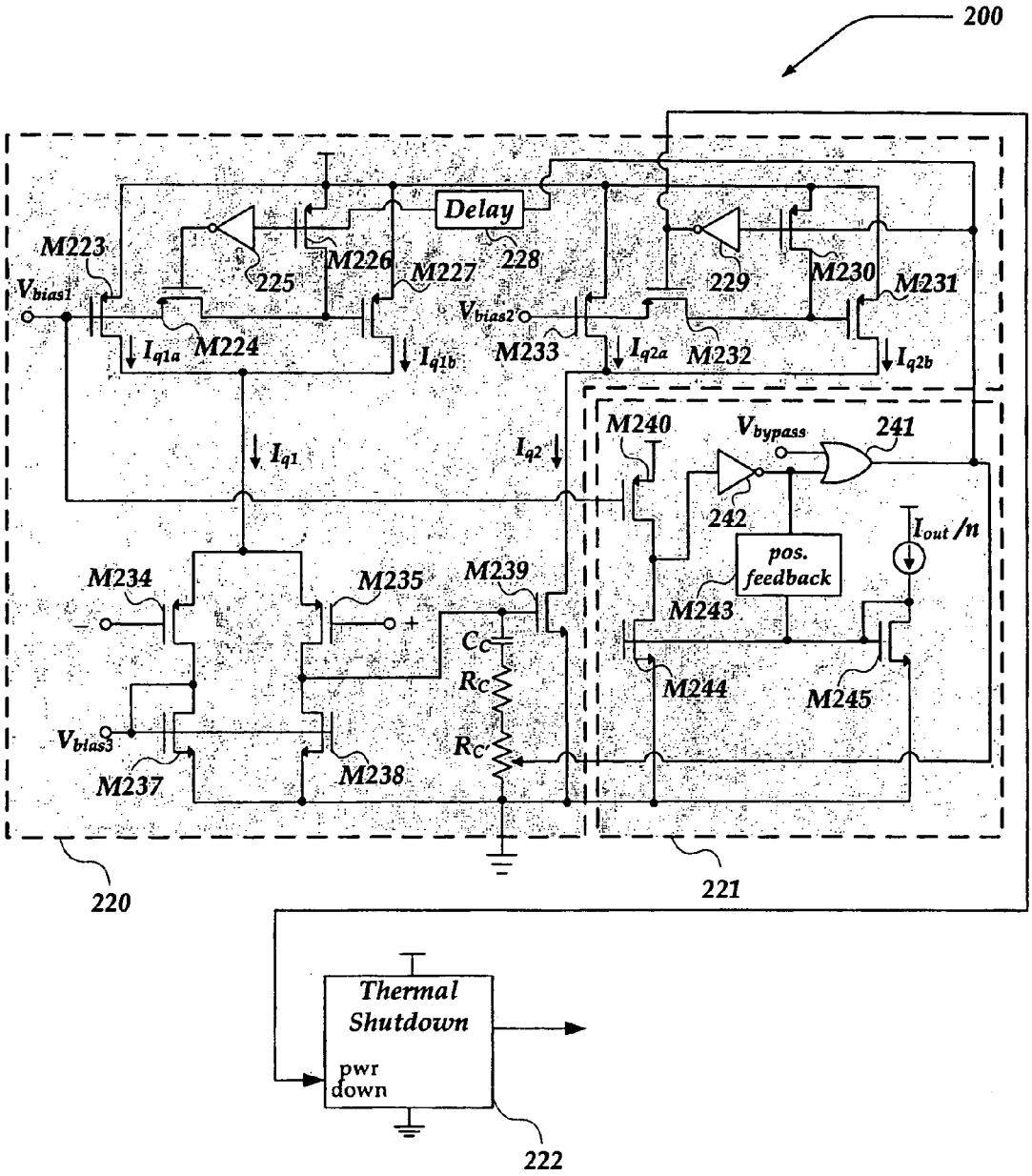
FIG. 2 schematically illustrates an embodiment of an error amplifier and a current comparator in a reducing quiescent current implementation.

FIG. 2 schematically illustrates an embodiment of error amplifier 220 and current comparator 221 in reducing quiescent current implementation 200. Reducing quiescent current implementation 200 further includes thermal shutdown circuit 222.

Error amplifier 220 includes parallel coupled transistors M223 and M227, which are arranged to receive first bias voltage $V_{bias1}$ at their gate terminals. Source terminals of M223 and M227 are coupled together such that source currents $I_{q1a}$ and $I_{q1b}$ provided by M223 and M227, respectively, are combined to $I_{q1}$. $I_{q1}$ is arranged to be provided to drains of M234 and M235, which are coupled together. Drain terminals of M234 and M235 are respectively coupled to source terminals of M237 and M238. Drain terminals of M237 and M238 are coupled together to a ground. M237 and M238 are further arranged to receive third bias voltage $V_{bias3}$ at their gate terminals.

Transistor M224 is coupled between the gate terminals of M223 and M227 such that $V_{bias1}$ is not provided to M227, if M224 is turned off. M224 is turned on and off by a control signal provided by current comparator 221. The control signal is processed by delay circuit 228 and inverter 225 before being provided to a gate terminal of M224.

A second bias circuit comprising transistors M233, M232, M230, and M231 is arrange to operate in a substantially similar manner as the first bias circuit comprising M223, M224, M226, and M227 as described above. Second bias voltage $V_{bias2}$ is provided to gate terminals of M233 and M231, which are arranged to provide $I_{q2a}$ and $I_{q2b}$, respectively.

$I_{q2a}$ and $I_{q2b}$ are combined into $I_{q2}$ and provided to a source terminal of M239. A drain terminal of M239 is coupled to the ground, and serially coupled capacitor Cc, resistors $R_C$ and $R_C$, are coupled between a gate terminal of M239 and the ground.

Current comparator 221 includes transistors M240, M244, and M245, inverter 242, OR operator 241, positive feedback circuit 243, and a current source. $V_{bias1}$ is provided to a gate terminal of M240 enabling M240 to provide a comparison current to Schmitt trigger inverter 242. An output of Schmitt trigger inverter 242 is coupled to an input of OR operator 241 along with an input of positive feedback circuit 243. An output of positive feedback circuit 243 is coupled to gate terminals of M244 and M245, which are arranged to operate as a current mirror and provide a $I_{out}/n$ to a source terminal of M240 from the current source. An output of OR operator 241, providing a result of OR operation between the output signal of inverter 242 and bypass voltage $V_{bypass}$, is provided to delay circuit 228 and $R_C$, of error amplifier 220.

In an operation M245 may operate as an over current sense diode and M244 may mirror $I_{out}/n$, which is also proportional to LDO output current $I_{out}$. A drain terminal of M244 is connected to a drain of a PMOS M240 current mirror. M240 may provide sources a constant reference current having a flat temperature coefficient. Accordingly, M240 and M244 may form a compact two-transistor current comparator circuit. By suitable scaling of these two transistors with respect to M245, the sense device employed for over current detection, any desired current trip-point threshold for low current detection may be set. In a typical application, the trip-point may be set about $I_{out}$=1 mA, for example. Schmitt trigger inverter 242 may buffer the comparator output to provide wave shaping that sharpens a digital output waveform edge.

Furthermore, comparator hysteresis may be added (or programmed) via a suitable positive feedback network to deliver cleaner output transitions. This may be accomplished by splitting M244 into multiple transistors and gating on and off different numbers of these transistors in the bank, resulting in different hysteresis thresholds being realized.

If LDO output current $I_{out}$ falls below a predetermined level (e.g. 1 mA), and is detected by current comparator 221 described above, the comparator output may switch to a logic HIGH level. If the "bypass" control at OR operator 241 is disabled, then transistors M226 and M231 are turned ON while transistors M224, M232, M227, and M233*a* are OFF. So, bias currents to first and second stages of error amplifier 220 are reduced due to the cutting off M227 and M231. By suitable selection of a M223 to M227 channel area ratio and/or a M233 to M231 channel area ratio, the circuit may realize a substantial range in quiescent current reduction while maintaining acceptable performance characteristics.

In general where critical, optimal system performance is sought at the expense of cost and circuit complexity, one may also choose to scale the transistors in the first and/or second stage amplifiers themselves. For example (refer to FIG. 2. transistors M234 and M235, M237 and M238, and M239 may be partitioned with their components partially or fully turned on or off via PMOS switches controlling their gate potentials exactly in the same manner as with the bias transistors on the top.

When the output current returns to a higher level, exceeding the predetermined level, the reverse logic level may causes M227 and/or M231 to turn on and operate in parallel with M223 and M233, respectively. In this case, the bias currents to error amplifier 220 become substantially similar to the bias currents when the quiescent current reduction is disabled.

Moreover, there may be another opportunity where additional power may be saved. When an output current demand is substantially low, power dissipation of the circuit also becomes very low. The thermal shut down circuit may become statistically insignificant when the LDO is practically in standby and dissipates only sub-mA to μA of total current. Therefore, whenever $I_{out}$ falls below 1 mA as an example, the thermal-shut down circuit may be optionally powered down. This can save an additional 2 μA of quiescent current from the LDO.

For example, if half of the bias current is attenuated from error amplifier 220 and the thermal shutdown circuit is disabled when substantially low output current is sensed, approximately 6 μA out of an original 12 μA quiescent current may be reduced. This is a 50% reduction in the LDO's quiescent current, which is a considerable amount of power that may be saved when the system is operating in low power.

Figure 3:
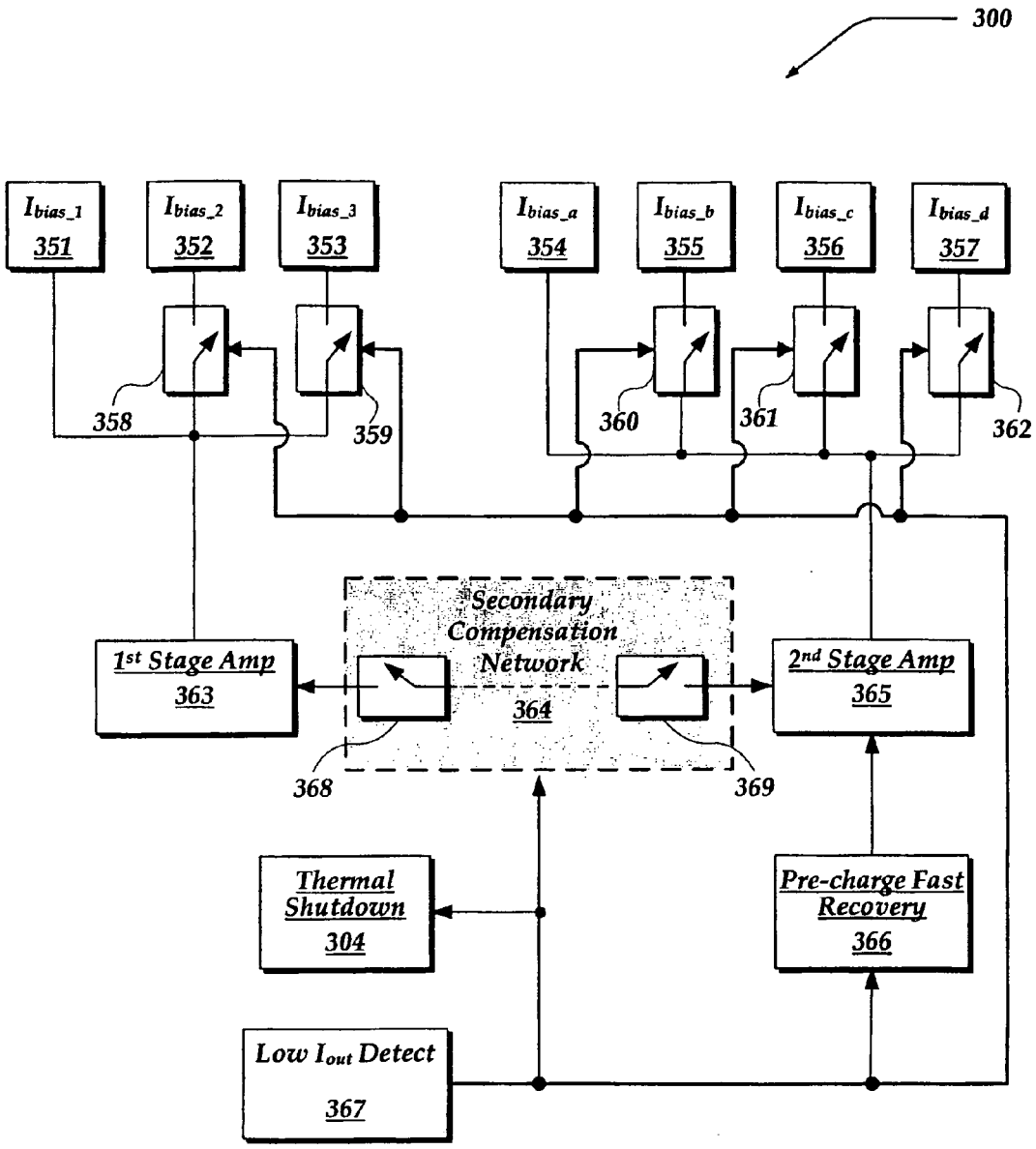
FIG. 3 illustrates an embodiment of an architecture for quiescent current reduction in an LDO regulator.

FIG. 3 illustrates an embodiment of architecture 300 for quiescent current reduction in an LDO regulator. Architecture 300 includes bias current generation banks comprising individual bias current generators 351–357, controlled switches 358–362, secondary compensation network 364 with controlled switches 368 and 369, first stage amplifier circuit 363, second stage amplifier circuit 365, thermal shutdown circuit 304, low output current detection circuit 367 and pre-charge fast recovery circuit 366.

Secondary compensation network 364 is arranged to control first and second stage amplifier circuits 363 and 365, which provide input current to individual bias current generators 351–357. The input currents may be disengaged by controlled switches 358–362. Low output current detection circuit 367 is arranged to control controlled switches 358–362. Low output current detection circuit 367 is further arranged to control thermal shutdown circuit 304 and pre-charge fast recovery circuit 366, disabling them if the LDO regulator is in a low power mode.

Individual bias current generators 351–357 may be implemented as the PMOS current source for the input differential pair in the first stage of the error amplifier and the PMOS load transistor used in the second stage in an LDO regulator such as LDO regulator 200 of FIG. 2. These 2 devices may each be partitioned and regrouped into two or more banks operating in parallel as shown in FIG. 3. In order to selectively switch transistors on and off within a grouping, a control signal is needed to effect this operation. While a digital signal from a source external of the LDO regulator may be employed, a self-contained detect-and-control mechanism such as Low output current detect circuit 367 may be employed as well. This implementation may also reduce power management software overhead.

Detection of low output current levels to trigger the switch-over of bias current may be accomplished by taking advantage of a built-in short circuit current detection circuit. The over current protection circuit may generally be implemented with a much smaller geometry of the same type transistor as a series power pass transistor used to regulate $V_{out}$, and may be configured to operate in tandem. This detector may comprise a two transistor current comparator that is made up by a NMOS that mirrors a small fraction of the LDO output current and a PMOS, which mirrors a fixed reference current, as shown in FIG. 2. Their common drain connection may be used as the comparator output. This comparator monitors when the output current becomes in excess of the allowable operation limit and issues a fault signal.

Figure 4:
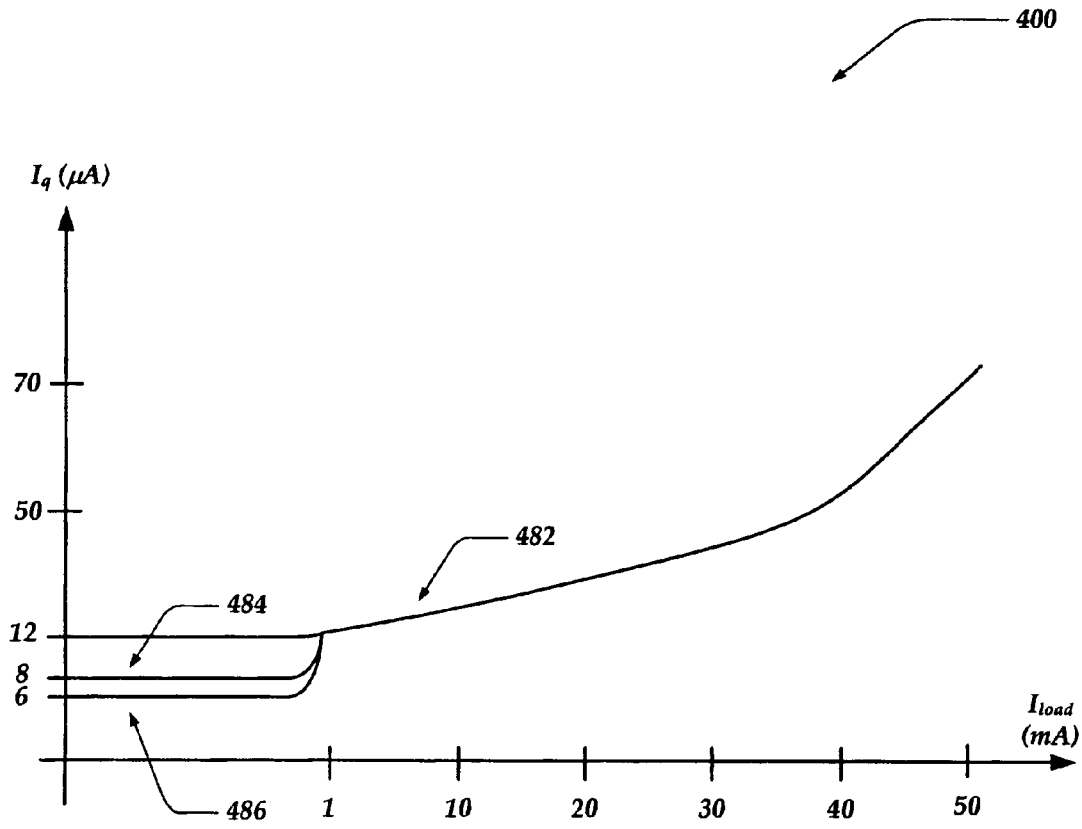
FIG. 4 illustrates a current diagram comparing load current versus quiescent current in an LDO regulator according to one embodiment of the present invention.

FIG. 4 illustrates current diagram 400 comparing load current versus quiescent current in an LDO regulator according to one embodiment of the present invention. Current diagram 400 includes comparison curve 482 representing a comparison of a conventional load current versus quiescent current, comparison curve 484 representing a comparison of load current versus quiescent current at a light load with quiescent current reduction management enabled, and comparison curve 486 representing a comparison of load current versus quiescent current at a light load with quiescent current reduction management enabled and thermal shutdown disabled.

As the figure shows, in an exemplary circuit according to one embodiment of the present invention-the net quiescent current is reduced by cutting down the quiescent current of thermal-shut-down and/or error amplifier circuits, when the quiescent current folding is set to trip at IL≦1 mA.

Comparison curves 482, 484, and 496 are representative curves showing comparison of quiescent and load currents of an exemplary LDO regulator circuit. The invention is not limited to the values shown, and other quiescent current and load current values may be obtained for other implementations of the circuit without departing from a scope and spirit of the invention.

The above specification, examples and data provide a description of the manufacture and use of the composition of the invention. Since many embodiments of the invention can be made without departing from the spirit and scope of the invention, the invention also resides in the claims hereinafter appended.

We claim:

1. A low-dropout (LDO) regulator circuit, comprising:

a power pass circuit that is arranged to receive an input voltage and an error voltage, and to provide a regulated output voltage in response to the input voltage and the error voltage;

an error amplifier that is arranged to receive a feedback voltage and a bias voltage, and to provide the error voltage in response to the feedback voltage and the bias voltage;

a bias generator that is arranged to provide the bias voltage;

a thermal shutdown circuit that is arranged to provide a thermal shutdown signal to the bias generator and the error amplifier such that the bias generator and the error amplifier are turned off based in part on the thermal shutdown signal; and an over current detection and control circuit that is arranged to provide a control signal such that the error amplifier is turned off based in part on the control signal.

2. The circuit of claim 1, further comprising a feedback circuit that is arranged to receive the output voltage and provide the feedback voltage.

3. The circuit of claim 2, wherein the feedback circuit comprises at least one resistor that is arranged to provide a predetermined portion of the output voltage as the feedback voltage to the error amplifier.

4. The circuit of claim 1, wherein the power pass circuit includes at least one serially coupled transistor.

5. The circuit of claim 4, wherein the error amplifier is arranged to provide the error voltage to a gate terminal of the at least one transistor such that a regulation of the output voltage is controlled by the error amplifier.

6. The circuit of claim 1, wherein the error amplifier is further arranged to receive the input voltage such that the error amplifier is turned off, if the input voltage drops below a predetermined limit.

7. The circuit of claim 1, wherein the bias generator comprises at least one of a voltage controlled voltage source and a current controlled voltage source.

8. A method for providing a regulated voltage, comprising:

receiving an input voltage;

providing a bias voltage' providing a output voltage based, in part, on the input voltage and an error voltage, wherein the error voltage is determined based in part on the output voltage and the bias voltage;

providing a thermal shutdown signal such that the error voltage is substantially reduced to zero, if a predetermined temperature limit is exceeded;

providing an over current detection and control signal such that the error voltage is substantially reduced to zero, if a predetermined over current limit is exceeded; and reducing the error voltage to substantially zero, if the input voltage drops below a predetermined limit.

9. The method of claim 8, wherein determining the error voltage comprises:

providing a feedback voltage to an error amplifier based in part on the output voltage;

providing the bias voltage to the error amplifier; and controlling an operation of the error amplifier with at least one of the thermal shutdown signal, the over current detection and control signal, and the input voltage.

10. The method of claim 8, further comprising:

employing a current comparator to disengage the thermal shutdown signal such that a system quiescent current is reduced when the system operates in a low power demand mode.

11. The method of claim 10, further comprising:

employing a bypass circuit to disengage an over current detection and control circuit when the system operates in the low power demand mode.

12. A low-dropout (LDO) regulator circuit, comprising:

a power pass circuit that is arranged to receive an input voltage and an error voltage, and to provide a regulated output voltage in response to the input voltage and the error voltage;

an error amplifier that is arranged to receive a feedback voltage and a bias voltage, and to provide the error voltage in response to the feedback voltage and the bias voltage;

a bias generator network that is arranged to provide the bias voltage, wherein the bias generator network comprises a plurality of bias generator circuits;

a thermal shutdown circuit that is arranged to provide a thermal shutdown signal to the bias generator and the error amplifier such that the bias generator and the error amplifier are turned off based in part on the thermal shutdown signal; and an over current detection and control circuit that is arranged to provide a control signal such that the error amplifier is turned off based in part on the control signal.

13. The circuit of claim 12, wherein the plurality of bias generator circuits are arranged to be switched on and off based in part on a predetermined algorithm.

14. The circuit of claim 12, wherein the thermal shutdown circuit is arranged to be disengaged by a current comparator circuit such that a quiescent current of the LDO regulator circuit is substantially reduced when the LDO regulator circuit is in a low power mode.

15. The circuit of claim 12, wherein the over current detection and control circuit comprises a current comparator that is coupled to a current limiting circuit.

16. The circuit of claim 15, wherein the current comparator circuit is arranged to provide a monitoring signal to a system monitor circuit such that the system monitor circuit is enabled to receive a status information about the LDO regulator circuit.

17. The circuit of claim 15, wherein the current comparator comprises:

a first current mirror that is arranged to provide a substantially constant reference current, wherein the first current mirror comprises two PMOS transistors; and a second current mirror that is arranged to provide a predetermined portion of a control current from the over current detection and control circuit, wherein the second current mirror comprises two NMOS transistors.

18. The circuit of claim 12, wherein the LDO regulator circuit is arranged to operate with a substantially reduced quiescent current when the LDO regulator circuit is in a low power mode.

19. The circuit of claim 12, further comprising a current comparator that is arranged to modify at least one of a charge time and a discharge time of a plurality of capacitors included in the LDO regulator circuit such that a response time of the LDO regulator circuit is substantially improved.

* * * * *

UNITED STATES PATENT AND TRADEMARK OFFICE

CERTIFICATE OF CORRECTION

PATENT NO. : 7,215,103 B1
APPLICATION NO. : 11/022128
DATED : May 8, 2007
INVENTOR(S) : Wong et al.

It is certified that error appears in the above-identified patent and that said Letters Patent is hereby corrected as shown below:

In column 2, line 66, delete "$V_{out}$," and insert -- $V_{in}$ --, therefor.

In column 4, line 34, delete "FIG.2." and insert -- FIG.2) --, therefore.

In column 5, line 60, delete "invention-the" and insert -- invention the --, therefor.

Signed and Sealed this

Twenty-sixth Day of June, 2007

JON W. DUDAS
*Director of the United States Patent and Trademark Office*